US005906511A

United States Patent [19]

Bozzer et al.

[11] Patent Number: 5,906,511

[45] Date of Patent: May 25, 1999

[54] MULTI-POSITION COAXIAL CABLE CONNECTOR

[75] Inventors: Dieter Bozzer, Mannheim; Patrik Duquerroy, Seligenstadt, both of Germany

[73] Assignee: The Whitaker Corporation, Wilmington, Del.

[21] Appl. No.: 08/543,548

[22] Filed: Oct. 16, 1995

[30] Foreign Application Priority Data

Oct. 17, 1994 [GB] United Kingdom ..... 9420935

[51] Int. Cl.[6] ..... H01R 9/05

[52] U.S. Cl. ..... 439/579; 439/608

[58] Field of Search ..... 439/579, 587, 439/588, 608, 609, 607, 731, 906, 638, 721, 63

[56] References Cited

U.S. PATENT DOCUMENTS

| | | | |
|---|---|---|---|
| 4,206,963 | 6/1980 | English et al. | 439/608 |
| 4,272,148 | 6/1981 | Knack, Jr. | 339/143 R |
| 4,659,166 | 4/1987 | Morningstar et al. | 439/731 |
| 4,690,481 | 9/1987 | Randolph | 439/741 |
| 5,055,070 | 10/1991 | Plegge et al. | 439/609 |
| 5,516,307 | 5/1996 | Carlesse et al. | 439/63 |

FOREIGN PATENT DOCUMENTS

| | | | |
|---|---|---|---|
| 1465315 | 4/1969 | Germany | 439/731 |
| 2 160 718 | 2/1985 | United Kingdom . | |
| 2 271 477 | 6/1992 | United Kingdom . | |

OTHER PUBLICATIONS

GB Search Report.

*Primary Examiner*—Gary F. Paumen
*Assistant Examiner*—Tho D. Ta

[57] ABSTRACT

A multi-position coaxial cable connector comprises a conductive housing and cover part mountable together for clamping coaxial leads therebetween. The conductive housing is provided with integrally moulded shrouds surrounding receptacle and pin contacts respectively. The contacts are mounted to a dielectric housing positioned in a recess of the housing and have a central bore with spring contacts therein. The central conductor of the leads can be inserted into the spring contacts for electrical connection thereto. Outer shielding of the coaxial leads are positioned in grooves of the housing and complementary recesses of the cover part engage in the grooves and tightly clamp the shielding to the housing around substantially the whole circumference for effective shielding.

11 Claims, 5 Drawing Sheets

MULTI-POSITION COAXIAL CABLE CONNECTOR

BACKGROUND OF THE INVENTION

1. Field of the Invention

This invention relates to a connector having coaxial terminals mounted therein, for interconnecting a coaxial cable to a complementary connector.

2. Description of the Prior Art

Coaxial connectors and cables are well known and used in many different applications for transmission of electrical signals, in particular high speed digital pulses, TV antenna and other such applications. Coaxial cables are composed of an inner conductor surrounded by a dielectric, which is then surrounded by an outer conductive shielding. At a connection between coaxial conductors via a coaxial connector, shielding continuity much be ensured. Signal energy losses often occur at the connector assembly due to the reduced shielding effectiveness of the connector in comparison to the cable. These losses not only adversely affect the signal to be transmitted, but also generate electromagnetic noise that may affect other electronic apparatus. It is therefore desirable to provide a coaxial cable connector that has very effective shielding with minimum losses. In certain applications, a plurality of coaxial connections need to be made, and it would therefore be desirable to provide a coaxial cable with effective shielding that comprises a plurality of coaxial terminals. Furthermore, it is a continuing requirement to provide connectors that are not only cost-effective to manufacture, but having few parts and being cost-effective to assemble and handle. It would also be desirable to provide such connectors in a manner easy to couple, are sturdy and provide a reliable electrical connection.

SUMMARY OF THE INVENTION

It is therefore an object of this invention to provide a coaxial connector assembly with means for effective shielding electrical continuity.

It is a further object of this invention to provide a coaxial connector for interconnecting a coaxial cable to a complementary coaxial connector, that is sturdy, reliable and cost-effective, and that can be easily assembled.

It is a further object of this invention to provide a reliable and effective coaxial connector for a plurality of coaxial connections, that has effective shielding, is cost-effective and reliable.

The objects of this invention have been achieved by providing a coaxial cable connector comprising a conductive housing having a base part and a cover part, the base part receiving at least one coaxial terminal therein having a central conductor for electrical connection to an inner conductor of a coaxial cable, and an outer concentric conductor integral with the base part, the base part and cover part having clamping surfaces for receiving an outer conductor of the coaxial cable for electrical connection thereto.

DETAILED DESCRIPTION OF THE PREFERRED EMBODIMENT

Figure 1:
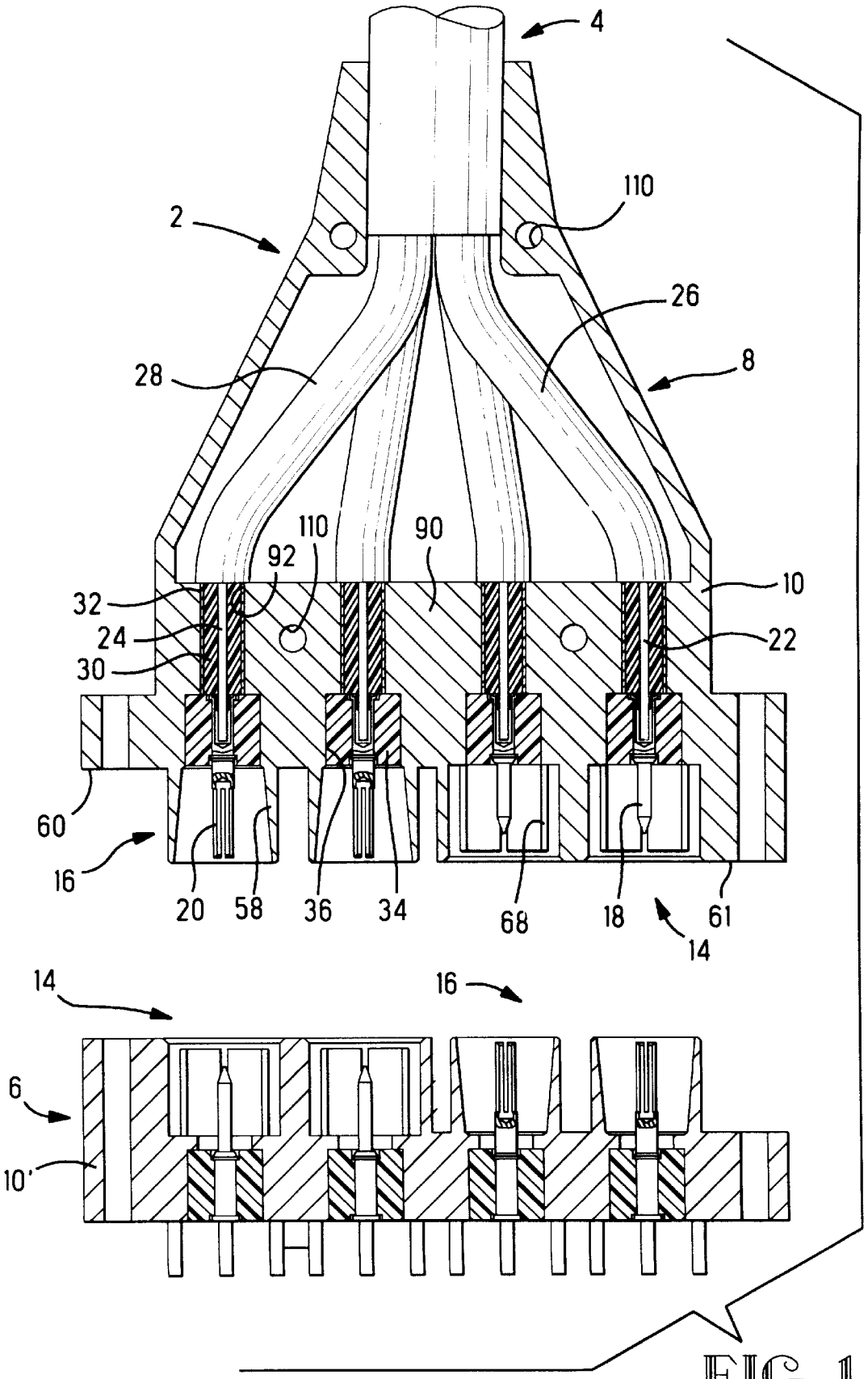
FIG. 1 is a cross-sectional view through a multi-position coaxial connector about to be coupled to a complementary coaxial connector.
Figure 2:
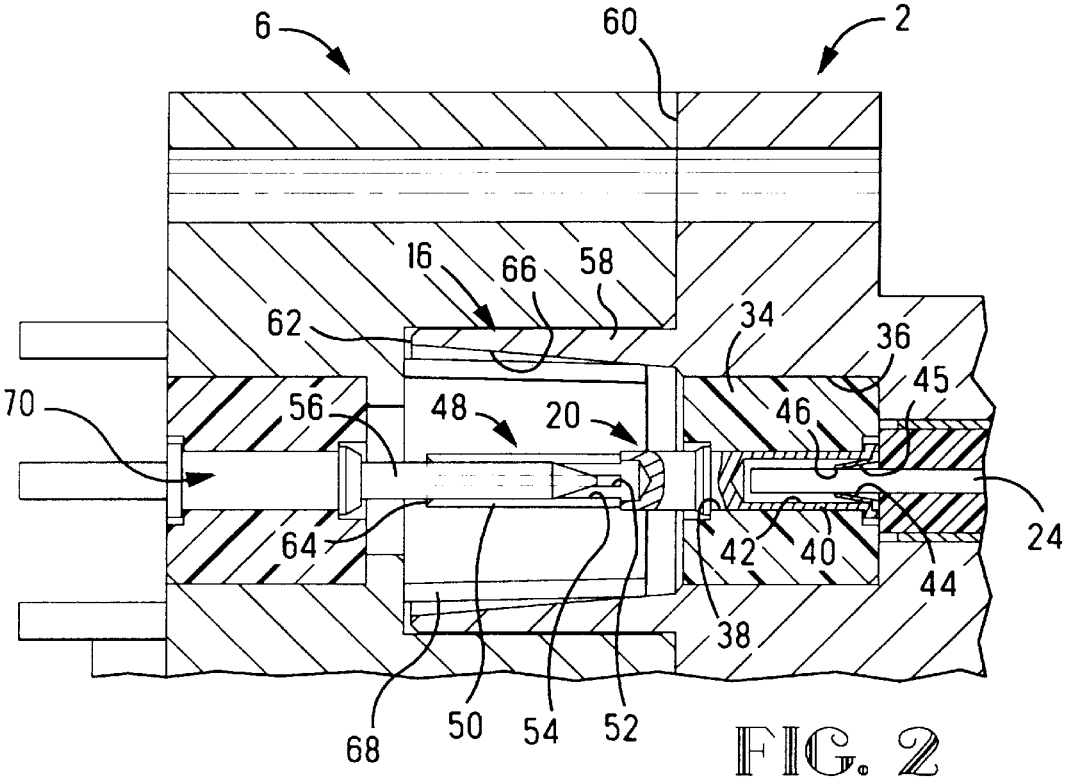
FIG. 2 is a detailed partial view of the connectors of FIG. 1 coupled.
Figure 3:
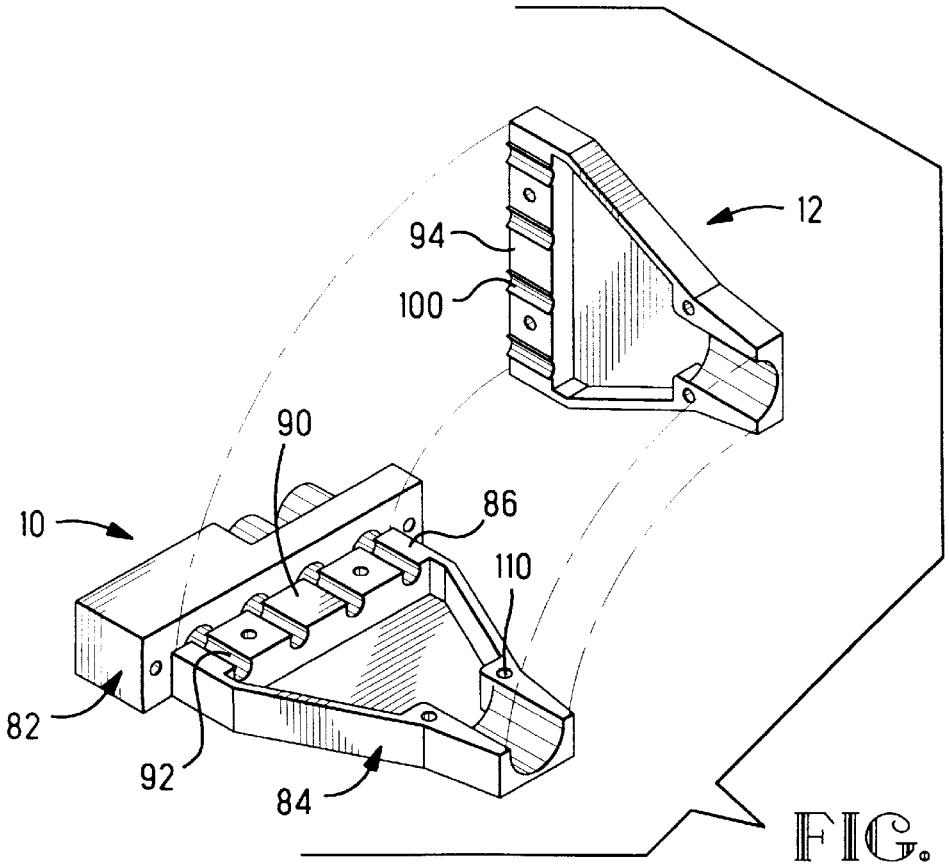
FIG. 3 is a schematic three dimensional view of a cover part exploded away from a base part of the coaxial connector.

Referring to FIGS. 1, 2 and 3, a coaxial connector 2 for interconnecting a coaxial cable 4 to a complementary coaxial connector 6, comprises a housing 8 having a base part 10 and a cover part 12. The connector 2 further comprises a plurality of coaxial terminals 14, 16 the terminals 14 comprising pin contacts 18 and the terminals 16 comprising receptacle contacts 20 for electrical connection to central conductors 22, 24 respectively of coaxial leads 26, 28 of the cable 4. The leads 26, 28 comprise a dielectric material 30 surrounding the inner conductor 24, further surrounded by a shielding conductor 32.

Referring to FIG. 2, the receptacle terminal 16 is shown comprising a dielectric housing 34 mounted in a cavity 36 of the base part 10. The housing 34 having a central through bore 38 for receiving a wire receiving portion 40 of the receptacle terminal 20 in a secure, locked manner. The wire receiving portion 40 comprises a central bore 42 having a concentric inwardly tapered spring clip 44 for receiving and electrically contacting the inner conductor 24. The spring clip 44 comprises longitudinally extending slots forming cantilever spring beams that resiliently bias against the inner conductor 24, the spring beams 45 preventing extraction of the conductor 24 by virtue of their tapered angle and sharply pointed forward edges 46 that dig into the conductor 24 and provide good electrical contact therewith. Extending longitudinally from the wire receiving portion 40, is a receptacle contact portion 48 having a plurality of cantilever beam contact arms 50 made by providing longitudinally extending slots 52 in a cylindrical member having a central bore 54 for receiving a pin contact 56 of the complementary connector 6 therein. The pin 56 has an outer diameter slightly greater than the bore 54 such that slight interference therebetween causes resilient outward biasing of the cantilever contact arms 50 for good electrical connection therebetween.

The terminal 16 further comprises a concentric shroud 58 extending beyond a mating face 60 of the connector 2, and concentrically surrounding the receptacle contact portion 48, the shroud 58 having a mating end 62 extending beyond a mating end 64 of the receptacle contact 20. The shroud 58 is integral with the housing base part 10 and has a substantially conical inner surface 66 for receiving and electrically contacting a concentric shroud 68 of the complementary connector pin terminal 14. The complementary connector pin terminal is denoted with the same numbering as the pin terminal 14 of the connector 2, as its design is similar, if not identical to the pin terminal 14. Similarly, receptacle terminals 16 of the complementary connector 6 are similar, if not identical, to the receptacle terminals 16 of the connector 2 and all features are therefore denoted with the same numbering. Descriptions of the pin and receptacle terminals 14,16 thus apply to both the connector 2 and complementary connector 6. The pin contacts 56 extend longitudinally into a wire receiving portion 70 that is constructed in a similar, if not identical manner to the wire receiving portion 40 of the receptacle contact 20. This can be seen more clearly by referring to FIG. 4 which shows a partial cross-section through the wire receiving portion 70, and therefore will not be explained in any further detail.

Figure 4:
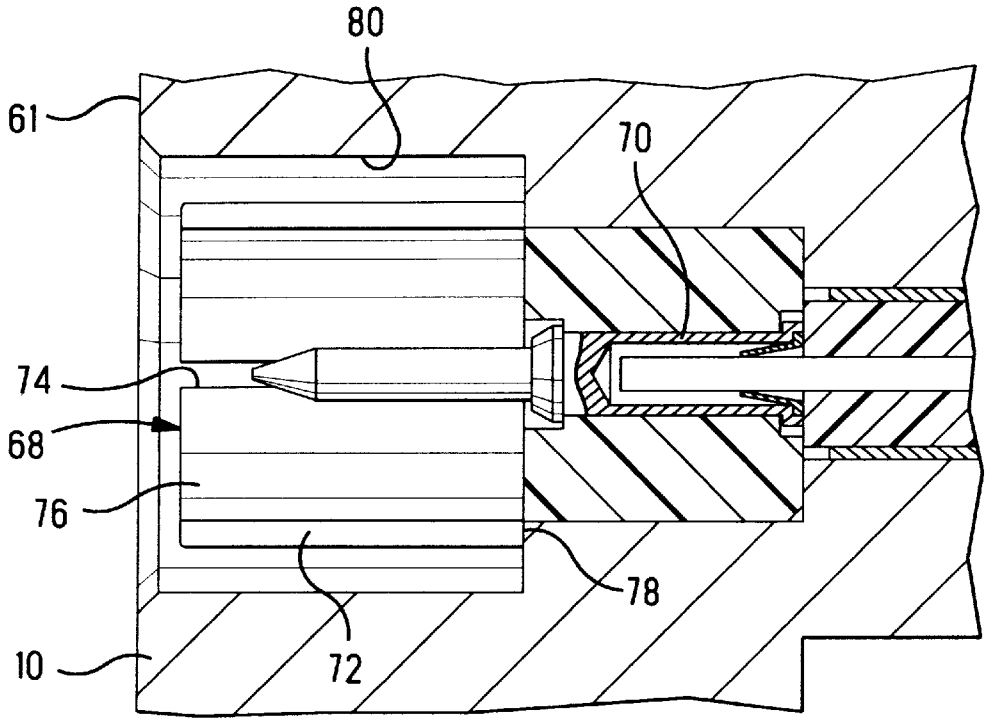
FIG. 4 is a detailed partial view in cross-section of a coaxial pin terminal of the connector.

Still referring to FIGS. 2 and 4, the cylindrical shroud 68 is shown comprising a cylindrical outer wall 72 separated into four quarters by longitudinally extending slots 74 that allow each of the portions 76 to be resilient in the radial direction, the concentric shroud 68 being attached at the connector end 78 integrally with the base part 10 of the connector 2, or the base part 10' of the complementary connector 6 depending on which connector 2, 6 is being considered. The pin contact 56 and concentric shroud 68 are positioned within a cylindrical cavity 80 extending within the housing 10 from a mating face 61.

Figure 11:
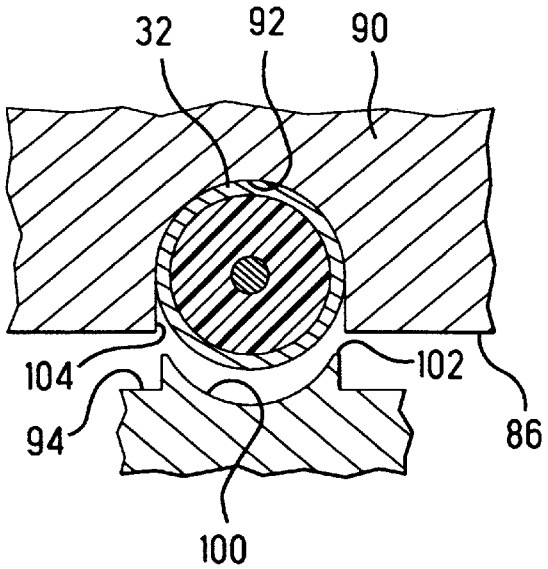
FIG. 11 is a partial view in cross-section showing a portion of the cover part about to clamp a coaxial cable against the base part.
Figure 7:
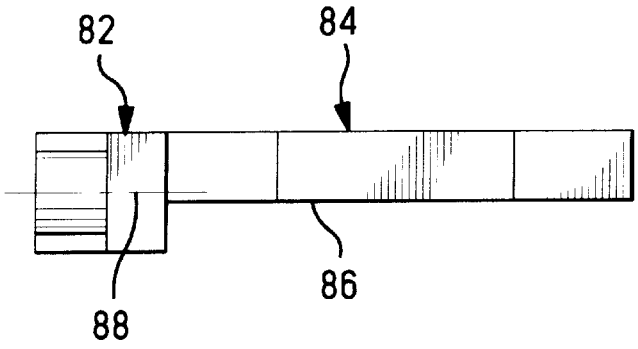
FIGS. 5, 6 and 7 are cross-sectional, side and end views respectively of the base housing part of a coaxial connector.
Figure 5:
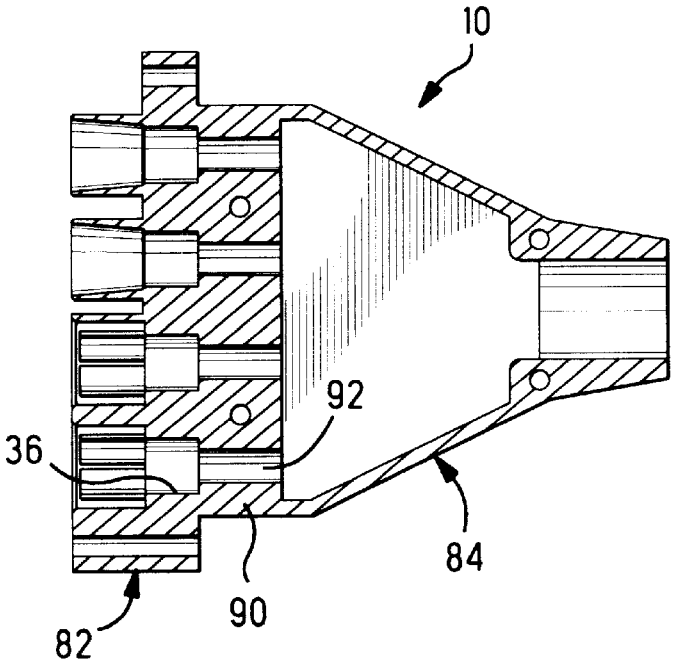
Figure 6:
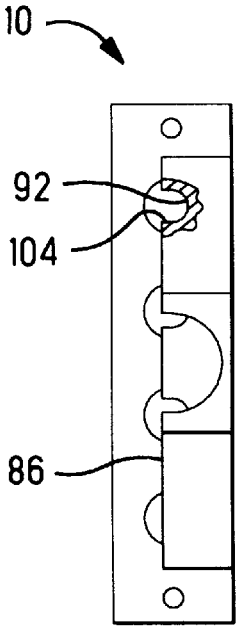
Figure 8:
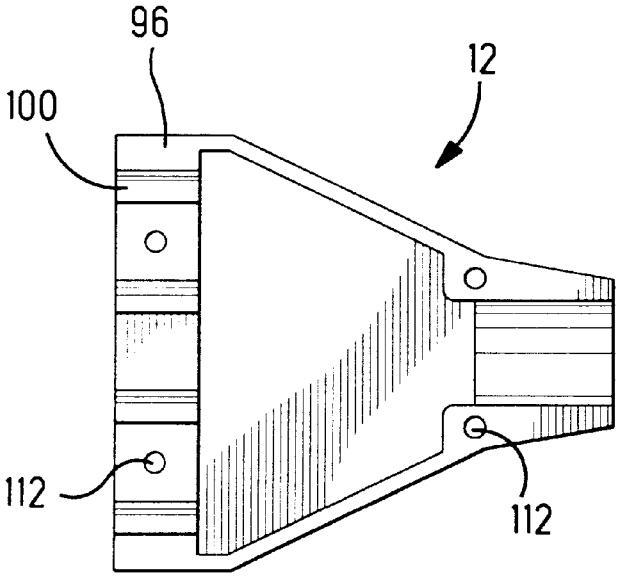
FIGS. 8, 9 and 10 are plan, end and side views of a cover part of the coaxial connector.
Figure 9:
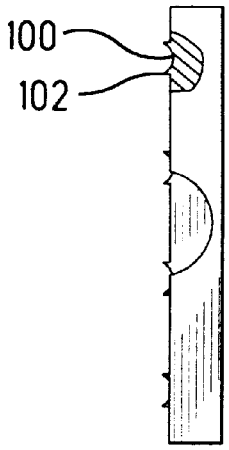
Figure 10:
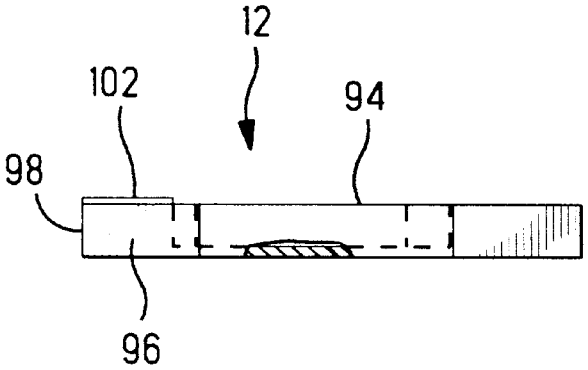

Referring now to FIGS. 3 and 5–11, the housing base part 10 is shown comprising a forward section 82 that comprises the concentric shrouds 58 and 68, and the cavities 36 for receiving the dielectric housing 34, and extending rearwardly therefrom is a half shell portion 84 that has a cover mounting face 86 positioned slightly beyond a plane 88 that substantially separates the connector in two halves and runs through the centre lines of the contacts 20, 18. The half shell portion 84 comprises a shield clamping portion 90 extending from the forward portion 82 and comprising a plurality of longitudinally disposed partial cylindrical grooves 92 for receiving the outer shielding 32 of the coaxial leads 26 therein as shown in FIG. 11. The cover part 12 comprises a mounting face 94 mountable against the mounting face 86 of the base part 10, and having a clamping plate 96 extending from a forward end 98 thereof that is mountable against the clamping portion 90 of the base part 10. The clamping plate 96 comprises partial cylindrically shaped longitudinally extending recesses 100 for positioning over the grooves 92 of the base part for clamping the outer shielding 32 of the leads 26, 28 therebetween, for good electrical contact therewith. The recesses 100 are flanked by raised edges 102 that extend longitudinally and are insertable against sides 104 of the base part grooves 92 in order to ensure the most effective contact and clamping of the outer shielding 32 around its whole circumference for greatest shielding effectiveness. Having the mounting face 86 above the centre plane 88, ensures that the shielding 32 of the lead 26, 28 is positioned well within the groove 92, and does not project over the mounting face 86 and thus get pinched therebetween when the cover part 12 is clamped to the base part 10.

Referring mainly to FIGS. 1, 3 and 11, the cable connector 2 is thus assembled to the cable 4 by first removing a certain length of the outer insulation of each of the inner leads 26, 28, removing a certain length of the outer shielding and dielectric to expose a portion of the inner conductor 24, inserting the inner conductors of each of the leads 26, 28 into respective cavities 42 of the pin and receptacle contacts 18, 20 for contact with the spring contacts 44, resting the exposed shielding within the grooves 92, and mounting the cover 12 to the base part 10 by screw means extending through holes 110, 112 over the base and cover parts respectively; finally tightening the screw means to clamp the mounting faces 86, 94 together thereby clamping and electrically connecting the lead outer shielding tightly to the cooperating surfaces of the grooves 92 and recesses 100.

The base 10 and cover parts 12 can be made by casting out of a conductive material such as aluminium alloy.

The cable connector 2 can then be coupled to the complementary connector 6 whereby the receptacle and pin terminals 16, 14 interengage such that the pin terminal shrouds 68 are guided by the inner tapered surfaces 66 of the receptacle terminal shroud 58 and make contact with the shroud 58 at a position distant from the mating end 62. The radial resiliency of the pin terminal shroud 72 enables resilient biasing thereof against the inner surface 66 of the shroud 58, thereby ensuring good electrical contact therebetween. Furthermore, shielding effectiveness is increased by having the contact point well within the shroud 58 and having integrally cast shrouds with their housing parts thus ensuring optimal electrical connection therebetween. Provision of the clamping platforms and cooperating recesses and raised edges thereof, ensures effective circumferential contact with the shielding of the leads with a few number of parts and a very sturdy construction.

The provision of pin and receptacle contacts on the connector assembly 2 for mating with complementary receptacle and pin contacts of the complementary connector 6 ensures that the connectors are correctly mated together and provides a hermaphroditic type of connection that reduces design and tooling costs for producing the connectors 2, 6.

Shielding effectiveness is further increased by providing the pin terminal shrouds 68 within a cavity 80 of the housing part such that the complementary mating shroud 58 is positioned therein.

We claim:

1. A coaxial cable connector for connection to coaxial conductor having an outer conductor and an inner conductor, the connnector comprising a housing having a base part, a cover part, and a coaxial terminal having an inner contact mounted in a dielectric and a conductive outer concentric shroud, the inner contact for connection to the cable inner conductor and the outer concentric shroud for contact to the cable outer conductor, characterized in that the base part comprises a mounting face that has a groove of a substantially partially cylindrical shape for receiving the cable outer conductor there againgst, the cover part having a clamping portion adapted to clamp the outer conductor in the groove, the groove being electrically conductive and electrically interconnected to the outer concentric shroud by integral formation therewith.

2. The connector of claim 1 wherein the clamping portion of the cover part has raised edges flanking a recess that receives the cable shielding there against, the raised edges insertable into the base part groove against opposed side walls thereof.

3. The connector of claim 1 wherein the cover part is integrally formed of a conductive material.

4. The coaxial connector of claim 1 wherein the connector has a plurality of coaxial terminals, and the base part has a corresponding number of grooves each for receiving a cable therein.

5. The connector of claim 4 wherein at least one of the plurality of coaxial terminals is a receptacle coaxial terminal.

6. The connector of claim 5 wherein the outer concentric shroud of at least one receptacle coaxial terminal comprises a substantially conical inner surface for contact with an outer concentric shroud or a complementary coaxial terminal.

7. The connector of claim 4 or 5 wherein at least one of the plurality of coaxial terminals is a pin coaxial terminal.

8. The connector of claim 7 wherein the outer concentric shroud of the pin coaxial terminal has axially extending slots for resilient radial biasing of the outer concentric shroud during connection with a complementary receptacle terminal.

9. The connector of claim 4 wherein the base part is an integral electrically conductive member including the outer concentric shrouds of the terminals.

10. The connector of claim 9 wherein the base part is past out of a metal alloy.

11. The connector of any of claims 1–6 and 2–3 wherein the base part comprises a forward section that comprises the one or more terminal outer concentric shrouds, and a half shell portion extending therefrom and having the mounting face, whereby the mounting face is on a plane that is beyond a centre axis of the coaxial terminal such that the one or more grooves have a depth greater than the radius of the cable shielding layer.

* * * * *